US006638900B2

(12) United States Patent
Ajmani et al.

(10) Patent No.: US 6,638,900 B2
(45) Date of Patent: Oct. 28, 2003

(54) TERNARY FOAMING CLEANER

(75) Inventors: Inderjeet K. Ajmani, Fremont, CA (US); Jessica Y. Chung, San Jose, CA (US)

(73) Assignee: The Clorox Company, Oakland, CA (US)

( * ) Notice: Subject to any disclaimer, the term of this patent is extended or adjusted under 35 U.S.C. 154(b) by 104 days.

(21) Appl. No.: 10/045,246

(22) Filed: Oct. 18, 2001

(65) Prior Publication Data

US 2003/0114340 A1 Jun. 19, 2003

(51) Int. Cl.[7] ..... C11D 3/00; C11D 7/18; C11D 7/54; C11D 17/00; C11D 77/04

(52) U.S. Cl. ..... 510/372; 510/195; 510/367; 510/406

(58) Field of Search ..... 510/302, 303, 510/367, 370, 372, 375, 379, 380, 406

(56) References Cited

U.S. PATENT DOCUMENTS

| | | | | | |
|---|---|---|---|---|---|
| 3,638,786 | A | * | 2/1972 | Borecki et al. | 206/47 A |
| 4,206,068 | A | * | 6/1980 | Davis | 252/89.1 |
| 4,619,710 | A | * | 10/1986 | Kuenn et al. | 134/22.17 |
| 4,664,836 | A | * | 5/1987 | Tayloe et al. | 252/91 |
| 5,264,146 | A | * | 11/1993 | Tobiason | 252/157 |
| 5,767,055 | A | * | 6/1998 | Choy et al. | 510/406 |

FOREIGN PATENT DOCUMENTS

| | | | |
|---|---|---|---|
| JP | 58191800 | * | 11/1983 |
| JP | 59024798 | * | 2/1984 |
| JP | 59164399 | * | 9/1984 |

* cited by examiner

*Primary Examiner*—Yogendra N Gupta
*Assistant Examiner*—John M. Petruncio
(74) *Attorney, Agent, or Firm*—Michael J. Mazza

(57) ABSTRACT

A composition is provided comprising three liquids which are separately maintained prior to forming an admixture during delivery to a surface to be treated, whereupon the admixture generates a heated foam sufficient for cleaning efficacy and stability. A first liquid preferably includes a hypohalite, or a hypohalite generating agent, a second liquid preferably includes a peroxygen agent and a third liquid includes a reducing agent, such as a thiosulfate. The first liquid is thickened to a specified rheology, resulting in the generation of a highly effective foam. As the liquids are initially separated, they can be maintained in an environment free of reactants and otherwise conducive to their activity and stability up to the time of use. When the liquids are allowed to mix, for example, by simultaneously pouring into a drain, the hypohalite and peroxygen react to liberate oxygen gas, while the hypohalite and thiosulfate react to generate heat. As foam generation occurs, the escaping gas contacts surfactant in the solution, and creates foam which expands to completely fill the drain pipe. The expanded foam is hot as a consequence of the exothermic reaction, and further contains an excess of the hypohalite, both of which act to clean the drain.

27 Claims, No Drawings

TERNARY FOAMING CLEANER

BACKGROUND OF THE INVENTION

1. Field of the Invention

The present invention relates to foaming cleaning compositions, and in particular to an in situ foaming cleaning composition incorporating a bleach and which is formulated to have utility as a drain cleaner, or as a hard surface cleaner.

2. Description of Related Art

Published Japanese applications to Ishimatsu et al JP 59-24798 and JP 60-32497; JP 59-164399, to Miyano et al, and Sakuma, JP 57-74379 all disclose, describe and claim a binary foaming cleaner having utility as a drain opener. None of these references, however, teach, suggest or disclose a thickened formulation, nor any of the advantages and foam characteristics associated therewith.

A hypochlorite composition paired with a chelating agent/builder solution in a dual chamber container is disclosed in U.S. Pat. No. 5,767,055 to Choy et al.

Drain cleaners of the art have been formulated with a variety of actives in an effort to remove the variety of materials which can cause clogging or restriction of drains. Such actives may include acids, bases, enzymes, solvents, reducing agents, oxidants and thioorganic compounds. Tobiason, U.S. Pat. No. 5,264,146, Steer, et al, U.S. Pat. No. 5,630,833 and Taylor, Jr. et al., U.S. Pat. No. 4,664,836 all disclose dry compounds which generate foam when mixed with water in a drain. Kuenn, U.S. Pat. No. 4,619,710 describes a dry in-sink garbage disposal cleaning composition which uses adipic acid and sodium bicarbonate to generate gas upon contact with water. This composition requires mechanical shearing from the disposal to assist in foam generation. Davis, U.S. Pat. No. 4,206,068 describes an exothermic drain opening composition comprising an oxidant and a reducing agent in a compartmentalized container.

SUMMARY OF THE PRESENT INVENTION

In view of the prior art, there remains a need for a cleaning composition capable of generating foam and heat in-situ. There further remains a need for foam-generating, exothermic composition which provides both chemical and physical cleaning especially on non-horizontal surfaces.

It is another object of the present invention to provide a composition capable of forming an active-carrying foam in situ.

It is another object of the present invention to provide a composition capable of generating a stable foaming active cleaner.

It is another object of the present invention to provide a triple component composition and containment means which isolates each component during storage.

It is another object to provide a drain opening composition which is formulated to be safe to store and use.

It is another object of the present invention to provide a foaming cleaning composition having utility as a drain cleaner by virtue of its rheology.

It is yet another object of the present invention to provide an exothermic cleaning composition.

More specifically, the composition is a product of three liquids or reactants which are separately maintained prior to forming an admixture during delivery to a surface to be treated, whereupon the admixture generates a heated foam sufficient for cleaning efficacy and stability. A first liquid includes an oxidant, such as a hypohalite or a hypohalite generating agent (hereinafter "hypohalite") a second liquid includes a gas generating agent, such as a peroxygen containing or releasing agent; and a third liquid includes a reducing agent, such as a thiosulfate compound. At least one of the liquids includes a surfactant. As the liquids are initially separated, each can be maintained in an environment free of reactants and otherwise conducive to their cleaning activity and stability up to the time of use. When the hypohalite and peroxygen compound are allowed to mix, for example, by simultaneously pouring into a drain, they liberate oxygen gas in accordance with the following reaction equation:

$$NaOCl+H_2O_2 \rightarrow O_2(g)+NaCl+H_2O$$

Moreover the thiosulfate, e.g. sodium thiosulfate reacts with the hypohalite to generate heat. The following equation is illustrative:

$$4NaOCl+Na_2S_2O_4+2NaOH \rightarrow 2Na_2SO_4+4NaCl+H_2O+\Delta H$$

The liberated gas contacts the surfactant in the solution, creating foam which expands to completely fill the drain pipe. The expanded foam contains an excess of the hypohalite, which acts to clean the drain. The resulting foam is sufficiently stable, a dense to remain in a vertical segment of the pipe to provide active cleaning. In one aspect of the invention, sufficient reactants are provided to yield a foam height sufficient to yield a greater than twelve centimeter column in the drain (as measured from the center or lowest point of the P-trap, and for a 3.2 cm. diameter drain), more preferably greater than seventeen cm. and most preferably seventeen to thirty-one cm. Preferred in terms of foam volume and height in the drain, is an amount sufficient to reach the drain's stopper mechanism, a site of frequent hair and/or soap contamination. Such stopper mechanisms are typically positioned about twenty cm. up the vertical pipe. The foam would preferably contain greater than 0.1% active, more preferably greater than 0.5% active, and most preferably between about 0.75 and 3% active. An active contact time, or foam half life, should be at least twenty minutes. Foam half-life is the time elapsed between maximum foam volume development and a 50% volume reduction thereof, absent any external forces (other than gravity) acting upon the foam. The foam is self-generating, produced by reaction of composition components, and requires no mechanical agitation or other forms of physical activation. In addition to the foam generated, the reaction between hypohalite and reducing agent generates heat, which is imparted to both the foam and liquid phases. A preferred temperature within the foam is sufficient to insulate the liquid phase from surrounding cold regions, for example at least about 30° C. The elevated temperature within the foam may also be sufficient to contribute to the melting of grease in the vertical pipe. A preferred temperature within the liquid phase is sufficient to melt grease, for example 40° C. or greater.

In one embodiment of the present invention, at least one of the three liquids includes a thickening agent or system, present in an amount such that when the liquids form an admixture during delivery to a surface, the admixture results in a dense, stable heated foam sufficient for cleaning efficacy and stability. Thus, when the initially separated liquids are allowed to interact, the resulting liquid cleaning composition being delivered to the surface will have the cleaning or bleaching activity and heat delivery appropriate for the cleaning or bleaching of that surface. The term "liquid" as used herein may include homogeneous liquids, solutions, suspensions and slurrys. An aqueous liquid is contemplated; however, nonaqueous liquids are within the scope of the invention. The thickening agent or system may impart both a viscous component and an elastic component to the corresponding liquid.

The present invention also relates to a container which maintains the three liquids separately until delivery and provides for such delivery, during which the pH-maintained admixture is formed and delivered to a surface to be treated. The container includes a first compartment for the hypohalite containing liquid, a second compartment for the peroxygen-containing liquid, and a third compartment for the thiosulfate-containing liquid. One, two or all three of the liquids contained therein may contain the thickening system or agent, present in an amount sufficient to thicken and for stability of the liquid, as described above. According to one aspect of the invention, the container may have separate delivery channels for the liquid components for delivering the liquids, whereupon the admixture is formed. These delivery channels may be constructed to provide for the contemporaneous delivery of the liquids to the exterior of the container, whereupon the liquids meet to form the admixture. Alternately, the separate delivery channels may communicate with an admixing space in which the two liquids form the admixture and from which the admixture is delivered to the exterior of the container.

The present invention further includes a method of cleaning surfaces comprising drains which comprises the step of:

pouring into a drain at least one liquid which resolves into a heated liquid phase and a heated foam phase in situ, the foam characterized by a density and stability sufficient to impart cleaning and a temperature of at least 30° C. and wherein the foam contains a cleaning-effective amount of a drain cleaning active. The liquid phase provides a temperature of at least about 40° C. for cleaning efficiency. It is also within the scope of the present invention to provide a single solution capable of generating the heated foam upon release from its container, as by pouring into the drain.

Briefly, a first embodiment of the present invention comprises a stable cleaning composition comprising, in aqueous solution:

(a) a first liquid containing an oxidizing agent; and (b) a second liquid containing a gas generating agent;

(c) a third liquid containing a reducing agent and wherein a first volume of the oxidizing agent and the gas generating agent react to generate a foam characterized by a density and stability sufficient to impart cleaning active, and a second volume of the oxidizing agent and the reducing agent further react to liberate heat, resulting in liquid phase having a temperature of at least about 40° C. and a temperature within the foam phase of at least 30° C., and wherein the foam contains a cleaning-effective amount of a drain cleaning active.

It should be noted that as used herein the term "cleaning" refers generally to a chemical, physical or enzymatic treatment resulting in the reduction or removal of unwanted material, and "cleaning composition" specifically includes drain openers, hard surface cleaners and bleaching compositions. The cleaning composition may consist of a variety of chemically, physically or enzymatically reactive active ingredients, including solvents, acids, bases, oxidants, reducing agents, enzymes, detergents and thioorgainic compounds. Unless otherwise specified, all ingredient percentages are weight percentages.

For purposes of the discussion of the invention disclosed herein, a typical household sink drain comprises four sections: a vertical section, thence to a U-bend (or P-trap), thence to a 90-degree elbow, and finally a horizontal sewer arm.

A viscous rheologoy, preferably one with an elastic component, most preferably a viscoelastic rheology, may be imparted to the oxidant liquid, for example, by a binary surfactant system. One such system includes a betaine or sulfobetaine and an anionic organic counterion. Such systems are more fully described in U.S. Pat. Nos. 4,900,467 and 5,389,157 to Smith, and assigned to the assignee of the invention herein, the disclosures of which are incorporated herein by reference.

The viscosity of the formulations of the present invention can range from slightly greater than that of water, to several thousand centipoise (cP). A preferred viscosity range for the first (oxidant-containing) liquid is about 250 to 2000 cP, alternatively about 500 to 1800 cP, or alternatively about 750–1500 cP. Preferred viscosity for both the second (gag generating) and third (reducing agent) liquids is about 0–50 cP, more preferred is 0–20 cP.

While some viscoelasticity is important to generate a stable, dense durable foam for chemical cleaning efficiency, too high a level of viscoelasticity will result in a reduction in the heat generation. Since the heat generation is optimized at a faster reaction rate, a less viscoelastic formulation will react faster, yielding a heat profile more effective at removing grease clogs. Thus the temperature will be elevated to a sufficient point and for a duration necessary to melt grease.

A second embodiment of the present invention is a composition and method for cleaning drains, the composition comprising separately maintained aqueous solutions of:

(a) a first liquid including a hypohalite compound and having a viscoelastic rheology;

(b) a second liquid including a peroxygen compound; and (c) a third liquid including a reducing agent.

The liquids (a), (b), and (c) are maintained separately during storage, and combined concurrently with, or immediately prior to use. Preferably, the liquids (a), (b) and (c) are maintained in a triple chamber or compartment bottle, and poured simultaneously into the drain wherein a portion of (a) and (b) react to generate foam, and a portion of (a) and (c) react to liberate heat. The resulting foam is stable and dense, and contains a high percentage of cleaning active, especially hypohalite, which coats the vertical and upper P-trap portions of a drain. The rheology of each composition provides a favorable rate of foam generation and residence time, resulting in excellent cleaning efficacy. The reaction between components (a) and (c) is exothermic, generating sufficient heat to melt grease. The foam should remain stable for an extended period of time, i.e. at least twenty minutes. The viscoelastic rheology may be imparted by a thickener, preferably a surfactant thickener.

It is therefore an advantage of the present invention that the composition is chemically and phase-stable, and retains such stability at both high and low temperatures.

It is another advantage of the present invention that, when formulated as a drain cleaner the composition provides both chemical and physical cleaning, improving the efficacy of the cleaner.

It is another advantage of the present invention that heat is generated, to provide additional physical cleaning efficacy.

It is yet another advantage of the present invention that the composition generates a stable, active-containing foam in-situ.

These and other objects and advantages of the present invention will no doubt become apparent to those skilled in the art after reading the following Detailed Description of the Preferred Embodiments.

DETAILED DESCRIPTION OF THE PREFERRED EMBODIMENTS

Oxidizing Agent

The oxidizing agent, or oxidant, may preferably be selected from various hypohalite-producing species, for example, halogen bleaches selected from the group consisting of the alkali metal and alkaline earth salts of hypohalite, haloamines, haloimines, haloimides and haloamides. All of these are believed to produce hypohalous bleaching species in situ. Preferably, the first oxidizing agent is a hypohalite or a hypohalite generator capable of generating hypohalous bleaching species. As used herein, the term "hypohalite" is used to describe both a hypohalite or a hypohalite generator, unless otherwise indicated. Hypochlorite and compounds producing hypochlorite in aqueous solution are preferred, although hypobromite is also suitable. Representative hypochlorite-producing compounds include sodium, potassium, lithium and calcium hypochlorite, chlorinated trisodium phosphate dodecahydrate, potassium and sodium dicholoroisocyanurate and trichlorocyanuric acid. Organic bleach sources suitable for use include heterocyclic N-bromo and N-chloro imides such as trichlorocyanuric and tribromocyanuric acid, dibromo- and dichlorocyanuric acid, and potassium and sodium salts thereof, N-brominated and N-chlorinated succinimide, malonimide, phthalimide and naphthalimide.

Also suitable are hydantoins, such as dibromo and dichloro dimethyl-hydantoin, chlorobromodimethyl hydantoin, N-chlorosulfamnide (haloamide) and chloramine (haloamine). Particularly preferred in this invention is sodium hypochlorite having the chemical formula NaOCl, in an amount ranging from about 0.1 weight percent to about 15 weight percent of the first liquid, more preferably about 0.1 to 10 weight percent, and most preferably about 1 to 8 weight percent. The oxidizing agent may be present in an stoichiometric amount to the gas generating agent for the generation of foam. If so, it is preferred that a separate cleaning active be included with either or both the first and second liquids. More preferred is that the oxidizing agent be present in a stoichiometric excess, to both generate foam and provide cleaning and drain opening activity.

Gas Generating Agent

The gas generating agent is a compound which can react with the oxidizing agent to generate a gas and is preferably a peroxide or peroxide-generator, such as hydrogen peroxide, or a peracid or persalt, including both organic and inorganic peracids and persalts, such as peracetic acid and monoperoxysulfate, respectively. A number, of peroxides, peracids and persalts are disclosed in U.S. Pat. No. 4,964,870, to Fong, et al, the disclosure of which is incorporated herein in its entirety by reference. Hydrogen peroxide is normally supplied as a liquid, although other hydrogen peroxide sources may also function satisfactorily. For example, perborate and percarbonate also supply $H_2O_2$ in solution. The gas generating agent is present in an amount of about 0.01 to 8 weight percent of the second liquid, preferably about 0.1 to 5 weight percent, most preferably about 0.2 to 3 weight percent.

Where peroxide is the gas generating agent and a hypohalite is the oxidizing agent, a weight ratio (to provide a stoichiometric excess) of hypohalite to peroxide is about 20:1 to 3:1, alternatively about 15:1 to 5:1, or 12:1 to 7.1. A mole ratio (to provide a stoichiometric excess) of hypohalite to peroxide is about to 30:1 to 10:1, or about 25:1 to 18:1.

Reducing Agent

The reducing agent can be any which react with the oxidizing agent to liberate heat. Where the oxidizing agent is a hypoholite, the preferred reducing agent is a thiosulfate, especially an alkali metal salt thereof. Generally suitable reducing agents are those which can react with a hypohalite to generate heat and may include reducing sugars, thio compounds such as thiourea and sulfur containing compounds such as sulfite and bisulfite, and others like borohydride, hydrazine and hypophosphite.

The reducing agent is present in a weight percent of 5 to 15%, preferably 7–13%. A mole ratio of oxidizing agent to reducing agent is about 8:1 to 3:1, or about 6:1 to 4:1. A mole ratio of reducing agent to gas generating agent is 5:1 to 1:1 or about 4:1 to 2:1.

Electrolyte/Buffer

An electrolyte/buffer may be included with either one or more of the liquids and preferably is included in the first, oxidant-containing liquid in a buffering-effective amount.

According to the present invention, suitable electrolytes/buffers may be selected from the group consisting of a carbonate, a phosphate, a pyrophosphate, an amino carboxylate, a polycarboxylate, a polyacrylate, a phosphonate, an amino phosphonate, a polyphosphonate, a salt thereof, and a mixture thereof. The electrolyte/buffer is present in an amount ranging from 0 to about 5 weight percent of the first liquid, preferably from about 0.01 to about 4 weight percent of the first liquid.

pH-Adjusting Agents

A pH-adjusting agent may be present in either one or more of the liquids, i.e., with the oxidant and/or gas generating agent. According to the present invention, the pH-adjusting agent maintains the pH of the liquid such that the active agent therein is stable and efficacious. The pH adjusting agent can be either alkaline or acidic in solution, and correspondingly serve to adjust and/or maintain either solution to an alkaline or acidic pH. In the present invention, each solution is maintained at a pH appropriate for the activity and stability of the oxidizing, gas generating agent, reducing agent and/or cleaning active therein. For an alkaline agents, such as a hypohalite and thiosulfate, the solution pH is alkaline. When the gas generating agent is peroxygen, and the pH is acidic. The pH-adjusting agent may be present in a pH adjusting effective amount, such as between about 0 and about 10 weight percent of one of the liquids.

For a peroxygen-containing liquid, especially hydrogen peroxide, it is preferred the pH be maintained below about 7, more preferably between 3 and 6 to maintain stability and efficacy of the peroxygen compound. An acidic pH-adjusting agent is present in an amount of from 0 to 5 weight percent to the second liquid, preferably from 0.001 to 2 weight percent.

When a hypohalite oxidizing agent is used, the pH of the solution is preferably maintained at above about 10, preferably above about 10.5, and more preferably above about 11. A solution pH of above about 11 is believed to be sufficient for both the cleaning efficacy and the stability of hypohalite. More particularly, this solution pH is believed to be sufficient to protect against the autocatalytic destruction of the hypohalite that might otherwise occur when the solution is formed. An alkaline pH-adjusting agent may be present in an amount of from 0 to 20 weight percent, preferably from 0.1 to 15 weight percent.

Thickener

In at least one embodiment of the present invention, the first oxidant solution or liquid is thickened, preferably with a surfactant thickener. Suitable thickeners are as described in previously referenced Smith patents. Other suitable systems may be found in the disclosures of U.S. Pat. No. 5,055,219 and U.S. Pat. No. 5,011,538 to Smith; U.S. Pat. No. 5,462,689 and U.S. Pat. No. 5,728,665 to Choy, et al., all commonly owned with the invention herein, and the disclosures of each of which are incorporated fully herein by reference. Additional thickeners such as polymers and gums are suitable as long as the desired foam characteristics and/or rheology is attained. Most preferred is a binary. surfactant viscoelastic thickener comprising a betaine and anionic counterion.

Betaine

Operative betaines include the $C_{14-18}$ alkyl betaines and $C^{14-18}$ alkyl sulfobetaines. Especially preferred is a cetyl dimethyl betaine (CEDB) such as Amphosol CDB (a trademarked product of the Stepan Company), which is about 95% or greater $C_{16}$, less than 5% $C_{12/14}$ and less than 1% $C_{18}$. It is noted that when referring to carbon chain lengths of the betaine or any other compound herein, the commercial, polydisperse forms are contemplated (but not required). Thus, a given chain length within the preferred $C_{14-18}$ range will be predominately, but not exclusively, the specified length. As used herein in reference to the betaine or sulfobetaine, the term "alkyl" includes both saturated and unsaturated groups. Fully saturated alkyl groups are preferred in the presence of hypochlorite. $C_{10-18}$ alkylamido and alkylamino betaines, and sulfobetaines having $C_{14-18}$ alkyl, or $C_{10-18}$ alkylamino or alkylamido groups, are also suitable for use in the compositions of the present invention.

The betaine is added at levels, which, when combined with the counterion, are thickening effective. Generally about 0.01 to 2 weight percent of the betaine is utilized for the oxidant liquid, or about 0.1 to 3% betaine, and preferred is about 0.5–2.0 percent betaine. The gas generating liquid contains betaine in an amount of between 0 and about 2%, or about 0.01 and 1%. The reducing agent liquid may contain 0 to about 4% betaine, or about 0.1 to 3%.

Counterion

The counterion is an anionic organic counterion selected from the group consisting of $C_{2-6}$ alkyl carboxylates, aryl carboxylates, $C_{2-10}$ alkyl sulfonates, aryl sulfonates, sulfated $C_{2-10}$ alkyl alcohols, sulfated aryl alcohols, and mixtures thereof. The aryl compounds are derived from benzene or napthalene and may be substituted or not. The alkyls may be branched or straight chain, and preferred are those having two to eight carbon atoms. The counterions may be added in acid form and converted to the anionic form in situ, or may be added in anionic form. Suitable substituents for the alkyls or aryls are $C_{1-4}$ alkyl or alkoxy groups, halogens, nitro groups, and mixtures thereof. Substituents such as hydroxy or amine groups are suitable for use with some non-hypochlorite cleaning actives, such as solvents, surfactants and enzymes. If present, a substituent may be in any position on the rings. If benzene is used, the para (4) and meta (3) positions are preferred. In some circumstances the cleaning active itself may be within the class of thickening-effective counterions. For example, some carboxylic acid cleaning actives may be present in both the acid and conjugate base forms, the latter which could serve as the counterion. The $C_{2-6}$ alkyl carboxylates may act in this manner. The counterion is added in an amount sufficient to thicken and result in a viscoelastic rheology, and preferably between about 0.01 to 5 weight percent. A preferred mole ratio of betaine to counterion depends on the chain length and concentration of the betaine, type of counterion, and the ionic strength of the solution, as well as whether the primary object of the composition is phase stability or viscosity. Using CEDB and sodium xylene sulfonate (SXS), a preferred mole ratio for the thickener components in the first, oxidant liquid is about 10:1 to 1:3, and more preferred is about 2:1 to 1:2. A preferred weight ratio of CEDB to SXS is about 3:1 to 1:1, and more preferred is 2:1 to 5:4.

The viscoelastic properties of a fluid can be measured with instruments such as a Bohlin VOR rheometer. A frequency sweep with a Bohlin rheometer can produce oscillation data which, when applied to a Maxwell model, result in parameters such as relaxation time (Tau) and static shear modulus (G0). The relaxation time of the oxidant containing formulation of the present invention are between about 3–15 seconds, alternatively between about 5–12 seconds. The ratio of relaxation time to static shear modulus (Tau/G0), previously defined as relative elasticity by Smith, may be between about 4–15 sec/Pascal (Pa,); alternatively between about 5–12 sec/Pa. Relative elasticity and relaxation times for the reducing agent liquid are about 3–10 sec/Pa and about 0.1–2 sec, respectively. Relative elasticity and relaxation times for the gas-generating liquid are 0 to about 0.5 sec/Pa and 0 to about 0.5 sec, respectively. While the thickeners described herein are effective to develop viscoelasticity over a range of solution ionic strengths, the ionic strength does influence rheology to some extent. Accordingly, unless otherwise stated, the relaxation times relative elasticities and viscosity values used herein are calculated for a first (hypohalite-containing) liquid having an ionic strength of about 2.5 molal. The reducing agent liquid may have an ionic strength of about 4.9 molal.

Adjuncts

A number of classes of adjunct compounds are known and are compatible with the first and second liquids and components thereof. One such class are adjunct cleaning actives, which interact with their intended target materials either by chemical or enzymatic reaction or by physical interactions, hereinafter collectively referred to as reactions. It is noted that either the oxidant or gas generating agent can function as the cleaning active, particularly when one is present in a stoichiometric excess over the other. Preferably, the oxidant is present in a stoichiometric excess over the gas generating agent to yield cleaning effective oxidant; however, a cleaning active may be additionally included. Useful active compounds thus include acids, bases, oxidants, solvents, enzymes, surfactants (detergents) and mixtures thereof. Examples of enzymes include lipases, keratinases, proteases, amylases, and cellulases. Useful solvents include saturated hydrocarbons, ketones, carboxylic acid esters, terpenes, glycol ethers, and the like. Various nonionic, anionic, cationic or amphoteric surfactants can be included, as known in the art, for their detergent properties. Examples include taurates, sarcosinates and phosphate esters. Other noncleaning active adjuncts as known in the art, such as corrosion inhibitors, dyes and fragrances, may also be included.

While compositions containing an oxidant liquid having a viscous rheology, especially a viscoelastic rheology, provide a benefit when applied to drains having porous or partial clogs (defined as one which causes the flow to diminish, but not to stop), the full benefit is obtained when the composition also possesses a density greater than water. This density may be attained without the need for a densifying material, however, when necessary to increase the density, a salt such as sodium chloride is preferred and may be added at levels of 0 to about 25 weight percent to the liquid, preferably 12–25 weight percent. With a porous or partial clog, foam generation occurs principally at the interface of the two liquids in the sink, and secondarily within the P-trap, permitting the foam to expand both upwards from the P-trap and downwards from the sink to contact fully the clogged portions of the drain, especially the vertical pipe. The expanding gas passes through the oxidant, entraining it into the foam and distributing it throughout the pipe. It is most preferred the first liquid (e.g. hypohalite) have a specific gravity of about 1.14; the third liquid (thiosulfate) have a specific gravity less than that of the first, for example, about 1.12; and the second liquid (peroxide) have a specific gravity of less than the third, or a specific gravity of about 1.05. Thus, for maximum effectiveness, the specific gravities are ordered hypohalite: thiosulfate: peroxide, i.e. hypohalite being the most dense, and peroxide the least dense.

The following table (Table I) illustrates the rheological characteristics of the components. The formulation used to obtain the results of Table I is shown below as Formulation I.

TABLE I

| Formula | Viscosity (cP) | Relative Elasticity (sec/Pa) | Relaxation Time (sec.) |
|---|---|---|---|
| hypochlorite (a) | 1350 | 6.8 | 7.3 |
| peroxide (b) | 8 | 0 | 0 |
| thiosulfate (c) | 22 | 6.4 | 0.7 |

Formula 1
(a) = 7.0% sodium hypochlorite, 1.85% sodium hydroxide, 0.057% sodium carbonate, 0.11% sodium silicate, 4.5% sodium chloride, 1.2% surfactant, balance water.
(b) = 0.68% hydrogen peroxide, 7% sodium chloride, 0.12% surfactant, balance water.
(c) = 10% thiosulfate, 5% sodium chloride, 2% surfactant, balance water.

Viscosities were measured on a Brookfield Rheometer, model DV-II+, with a teflon®-coated number 2 spindle at 5 rpm after two minutes. Tau, G0 and relaxation times were measured on a Bohlin VOR at 25° C. in the oscillatory mode. Viscosity was measured weekly over a period of twenty weeks and after storage at room temperature (21 degrees C.). The formulations of the present invention are stable over time, and do not exhibit any marked fluctuations during storage. After a short period of viscosity development, the viscosity value remains within about 15–25% of the initial viscosity.

Foam volume development was measured by pouring about 600 ml of a composition according to Example (a) above, into a 2 L graduated cylinder.

Foam volume was visually measured at various intervals. Foam develops rapidly, such that after 3 seconds a 400 ml volume of foam has developed, and after 5 seconds the foam volume is 500 ml. Thereafter, foam volume remains constant at 500 ml through four minutes. Foam development is thus characterized by an initial phase which begins when the liquids are combined, for example in a drain or on a surface, at time zero ($t_0$). The initial phase generally lasts about 3–5 seconds from to and displays a rate of foam generation of about 90–130 ml/sec.

Other foam properties of interest include foam density and stability. A dense, stable foam will allow longer contact time between cleaning actives and organic clog materials. A foam density range is about 0.07–0.15 g/mL. Foam stability is defined as the foam's resistance to a force tending to collapse or displace the foam. For the present invention, foam stability is determined by measuring the rate of travel of a standard object through a column of foam.

The foam is generated at a rate sufficient to permit a high column of foam preferably one which can rise to 10–30 cm in a standard 3.2 cm diameter drain pipe. Sufficient oxidant liquid remains, after reacting with gas-generating agent to generate foam, to react with the reducing agent to generate heat. The liquid oxidant and reducing agent remain in the U-bend (or P-trap) and react in the liquid phase generating heat. Because grease tends to deposit in the U-bend, the presence of the two heat generating liquids there concentrates heat generation at the point of grease build-up resulting in most efficacious grease removal.

Table II is a heat profile, showing temperatures attained both in the foam column, and in the liquid phase. The data were obtained by pouring 600 ml of formula 1 into a two liter graduated cylinder, and periodically measuring temperatures in the foam and liquid phases.

An elevated temperature is useful to aid in melting grease and fatty deposits, thus in one embodiment the reducing agent and oxidant react to liberate sufficient heat to raise the foam temperature to 30° C.; and/or to raise the temperature in the liquid solution below the foam to at least 40° C. and up to 50° C. The reaction between the hypohalite and reducing agent should be sufficient to yield a heat of 50–80 Kcal/mole of oxidant.

TABLE II

| Time (min:sec) | Foam (C. °) | Liquid (C. °) |
|---|---|---|
| 0:50 | 40.0 | 41.7 |
| 1:10 | 39.4 | 44.9 |
| 1:52 | 40.1 | 47.8 |
| 2:15 | 40.1 | 49.7 |
| 2:34 | 39.3 | 51.3 |
| 3:04 | 38.8 | 51.7 |
| 4:03 | 38.8 | 51.1 |
| 5:01 | 39.1 | 50.4 |
| 6:06 | 39.4 | 49.9 |
| 7:06 | 37.9 | 49.9 |
| 8:30 | 38.2 | 49.0 |
| 9:30 | 35.7 | 49.2 |
| 11:08 | 35.7 | 49.2 |
| 15:00 | 35.1 | 47.6 |
| 20:00 | 33.4 | 46.8 |
| 25:00 | 32.7 | 45.6 |
| 30:00 | 32.6 | 43.6 |
| 40:00 | 32.2 | 43.1 |
| 50:00 | 30.2 | 40.9 |
| 60:00 | 30.2 | 39.0 |

Table III displays temperature data obtained in the drain pipe. Again, 600 ml of Formula 1 was poured into a sink, having a clear polyvinyl chloride drain pipe assembly. Temperatures were measured at the identified locations by means of an IR thermometer. It can be seen that the P-trap regions, where grease is most likely to collect, exhibited the highest temperatures. Generally, for greasy clogs, a temperature above about 40° C. is sufficient to melt the clog.

TABLE III

| Pipe Location | Temperature (C. °) 5 min | Temperature (C. °) 20 min |
|---|---|---|
| 1 sink | 30.0 | 25.0 |
| 2 1–3 cm down vertical pipe | 36.7 | 31.1 |
| 3 11–13 cm down vertical pipe | 35.0 | 29.4 |
| 4 16–18 cm down vertical pipe | 40.6 | 37.8 |

TABLE III-continued

| | Pipe Location | Temperature (C. °) 5 min | Temperature (C. °) 20 min |
|---|---|---|---|
| 5 | middle of p-trap, lower surface | 41.1 | 41.7 |
| 6 | middle of p-trap upper surface | 46.7 | 43.3 |
| 7 | 3–5 cm below 90° elbow | 51.7 | 47.2 |
| 8 | 3–5 cm into sewer arm | 52.2 | 45.6 |
| 9 | 10–15 cm into sewer arm | 39.4 | 35.0 |

In another embodiment, the present invention comprises a drain opening formulation and method of use. The formulation includes, a first liquid comprising:

(i) a hypohalite;

(ii) a corrosion inhibitor;

(iii) a buffer;

(iv) a pH adjusting agent, and (v) a thickener a second liquid comprising:

(i) a peroxide;

(ii) a pH adjusting agent; and (iii) a densifying agent;

and a third liquid comprising:

(i) a thiosulfate (ii) a thickener and wherein the first and second and third liquids are separately maintained, for example, in separate chambers of a tri-chambered bottle, and admix upon, concurrently with or shortly after dispensing into a drain. A most preferred method of opening drains involves pouring the three liquids, simultaneously from a tri-chambered bottle, into a drain to be cleaned, and allowing a period of time for the heated foam to physically melt grease deposits, while the active entrained within the foam chemically or enzymatically decomposes the obstruction.

An example of a drain cleaning formulation includes a first aqueous composition comprising:

(i) a $C_{14-18}$ alkyl betaine or sulfobetaine;

(ii) an anionic organic counterion;

(iii) an alkali metal hydroxide;

(iv) an alkali metal silicate;

(v) an alkali metal carbonate; and (vi) an alkali metal hypochlorite a second aqueous composition comprising;

(i) hydrogen peroxide; and (ii) sodium chloride;

and a third aqueous composition comprising;

(i) a $C_{14-18}$ alkyl betaine or sulfobetaine;

(ii) an anionic organic counterion;

(iii) a thiosulfate

Components (i) and (ii) comprise the viscoelastic thickener and are as described previously. The alkali metal hydroxide is preferably potassium or sodium hydroxide, and is present in an amount of between about 0.5 and 20% percent. The alkali metal silicate is present in an amount of about 0 to 5 percent. The alkali metal carbonate e.g. sodium carbonate, is at levels of between about 0 and 5 percent. About 1 to 15 percent hypochlorite is present, preferably about 4 to 8 percent.

Generally, the preferred betaine for use with hypochlorite is an alkyl dimethyl betaine or sulfobetaine compound having a 12 to 18 carbon alkyl group, and most preferably the betaine is CEDB. The alkylamido betaines and alkylamino betaines are not preferred in the presence of hypochlorite. Substituted benzene sulfonic acids are preferred as the counterion with xylene sulfonic acid being most preferred.

FORMULATION EXAMPLES

Formulation Example 1

| Liquid 1 - Oxidant | Weight Percent | Liquid 2 - Gas Generator | Weight Percent | Liquid 3 - Reducing Agent | Weight Percent |
|---|---|---|---|---|---|
| Sodium hypochlorite | 1–10 | Hydrogen peroxide | 0.1–10 | Alkali metal thiosulfate | 5–25 |
| Sodium hydroxide | 0.5–10 | Sodium chloride | 0–25 | Surfactant thickener | 0.1–3 |
| Sodium carbonate | 0–5 | Sulfuric acid | 0.001–5 | Water | balance |
| Sodium silicate | 0–5 | Water | Balance | | |
| Surfactant | 0.1–20 | | | | |
| Water | Balance | | | | |

Hypochlorite chemical stability was measured after six weeks of at a storage temperature of 21 degrees C. After three weeks 96% active remained, and 91% after six weeks. Additionally, the formulation was phase stable after storage for 32 weeks at 1.7° C.

INDUSTRIAL APPLICABILITY

A composition of the present invention comprising 100 mls of peroxide, 100 mls of thiosulfate and 400 mls of hypochlorite was tested repeatedly on full and partial hair clogs.

Table IV demonstrates the performance benefits of the present invention. Displayed are results on full and partial hair clogs, and full grease clogs. Partial hair clogs were made using 2 g of hair, dried and cut into approximately 15 cm length. This hair was then placed in a test sink, and rinsed into the drain. An unclogged drain was found to have a flow rate averaging about 15 liters/minute; a flow rate of about 12 l/minute or less was considered to be a slow, or partially clogged, drain. Full hair clogs were made by mixing 15 g of hair (cut into 15 cm lengths) with 7.5 g of soap. The mixture was rinsed down the test drain, and the effectiveness of the clog was evaluated by visually confirming the absence of water flow. Grease clogs were made by mixing equal parts of solid vegetable shortening, lard and tallow, melting the mixture, and pouring into the drain where it was allowed to solidify. Again the effectiveness of the clog was evaluated by visually confirming the absence of water flow.

TABLE IV

| | Partial Hair Clog | | Full Hair Clogs | Grease Clog |
|---|---|---|---|---|
| Test | % Hair Dissolved | Flow Rate Imp. | Time to clear (min:sec) | % Flow Rate Imp. |
| 1 | 58.8% | 62.1% | 1:00 | 28.6% |
| 2 | 65.9% | 67.9% | 2:23 | N/A |
| 3 | 56.7% | 104.5% | 1:00 | 87.5% |
| 4 | 69.9% | 100.0% | 2:00 | 162.5% |
| 5 | 66.3% | 168.8% | 1:23 | 100.0% |
| 6 | 40.5% | 68.0% | 10:48 | 333.3% |
| 7 | 44.3% | 126.3% | 10:10 | 285.7% |
| 8 | 64.9% | 144.4% | 1:23 | 144.4% |
| 9 | 43.5% | 100.0% | Didn't Clear | 90.0% |
| 10 | 52.6% | 145.05% | 1:39 | 28.1% |
| 11 | 40.5% | 91.3% | 1:31 | 140.0% |
| 12 | 54.9% | 107.1% | 3:19 | N/A |
| Average | 54.9% | 107.1% | 3:19 | 140.0% |

Flow rates were measured as the time for 2 liters of water to drain from the sink. After the completion of each test wherein hair was the clog material, the remaining hair was rinsed, dried overnight at 25° C., and weighed. The present invention dissolved an average of 55% of the hair, and flow rates improved by an average of 107% (hair clogs), and 140% (grease clogs). For full hair clogs, improvement was measured by the time to clear (rather than flow rate improvement), since flow rate is restored to its normal value. It has been found that once a base amount of hair has been dissolved, the remaining hair has insufficient volume to clog the drain and will simply be rinsed away, thus restoring the drain to 100%. Thus all remaining hair after the treatment by the composition of the present invention was flushed completely out of the drain.

A most preferred method of opening drains involves pouring three liquids, as illustrated by Formulation Example 1, simultaneously from a tri-chambered bottle. A most preferred dual chamber bottle comprises one having side-by-side, equal capacity chambers and a single dispensing orifice.

A preferred bottle orientation during pouring results in both liquids exiting the dual chambered container such that optimum foam generation occurs in the drain pipe.

While described in terms of the presently preferred embodiment, it is to be understood that such disclosure is not to be interpreted as limiting. Various modifications and alterations will no doubt occur to one skilled in the art after having read the above disclosure. Accordingly, it is intended that the appended claims be interpreted as covering all such modifications and alterations as fall within the true spirit and scope of the invention.

What is claimed is:

1. A composition for cleaning comprising (a) a first liquid including an oxidant;

(b) a second liquid including a gas generating agent;

(c) a third liquid including a reducing agent; and wherein the first, second and third liquids are separately maintained prior to forming an admixture during delivery to a surface to be treated, whereupon the admixture produces a heated foam phase and a heated liquid phase, said heat and foam sufficient for cleaning efficacy.

2. The composition of claim 1 wherein the first liquid includes a viscoelastic thickener.

3. The composition of claim 2 wherein the viscoelastic thickener includes a betaine surfactant and an aryl sulfonate surfactant.

4. The composition of claim 1 wherein the third liquid includes a viscoelastic thickener.

5. The composition of claim 1, wherein the oxidant is selected from the group consisting of the alkali metal and alkaline earth salts of hypohalite, haloamines, haloimines, haloimides, haloamides and mixtures thereof; the gas generating agent is selected from the group consisting of organic and inorganic peracids, organic and inorganic persalts, peracetic acid, monoperoxysulfate, hydrogen peroxide, and mixtures thereof; and the reducing agent is selected from thiosulfates, thioureas, reducing sugars, and mixtures thereof.

6. The composition of claim 1 wherein the oxidant is present in a stoichiometric excess over the gas generating agent.

7. The composition of claim 6 wherein the oxidant is present in a stoichiometric excess over the reducing agent.

8. The composition of claim 1 wherein foam is generated at an initial rate of about 90–130 ml/sec.

9. The composition of claim 1 wherein the heat generated is sufficient to raise the temperature of the liquid phase to about 40° C.

10. The composition of claim 9 wherein, said 40° C. temperature in the liquid phase lasts for at least 30 minutes.

11. The composition of claim 1, wherein, the foam is characterized by a density of at least about 0.1 g/ml, a half life of greater than about twenty minutes, and wherein the foam contains a drain cleaning-effective amount of a drain cleaning active.

12. The composition of claim 1 wherein the composition provides a heat of greater than about 50 Kcal/mole.

13. An in-situ foaming drain cleaner comprising (a) a first viscoelastic liquid including an oxidant and a surfactant;

(b) a second liquid including a gas-generating agent; and (c) a third liquid including a reducing agent; and wherein the first, second and third liquids are disposed in a container such that they are separately maintained prior to forming an admixture during delivery to a drain to be treated, whereupon the admixture produces a heated foam phase, and a heated liquid phase, the foam phase being sufficient for cleaning efficacy, and having a density of at least about 0.1 g/l; a half-life of at least about twenty minutes, and capable of a temperature of at least about 30° C.; the liquid phase including oxidant, and capable of reaching a temperature of at least about 40° C.

14. The composition of claim 13 wherein the oxidant is present in a stoichiometric excess over the gas-generating and reducing agents, wherein said excess acts as a drain-opening active.

15. The composition of claim 13 wherein the third liquid includes a viscoelastic thickener.

16. The composition of claim 15 wherein the first liquid has a viscosity of at least about 500 cP, a relaxation time of about 5–15 sec, and a relative elasticity of about 3–15 sec/Pa; and the third liquid has a viscosity of at least about 10 cP, a relaxation time of about 0.1–2 sec, and a relative elasticity of about 3–15 sec/Pa.

17. The composition of claim 13 wherein the admixture generates a heat of reaction of at least about 50 Kcal/mole.

18. The composition of claim 13 wherein, said 40° C. temperature in the liquid phase lasts for at least 30 minutes.

19. The composition of claim 13 and further including a drain opening active.

20. The composition of claim 13 wherein the first liquid includes a betaine surfactant and an aryl sulfonate surfactant.

21. The composition of claim 20 wherein the third liquid includes a betaine surfactant and an aryl sulfonate surfactant.

22. The composition of claim 13 and further including: an alkali metal hydroxide, an alkali metal silicate, an alkali metal carbonate, and an alkali metal chloride.

23. A method for clearing restrictions caused by organic materials in drain pipes comprising (a) introducing into a drain at least one liquid, a first quantity of which generates a heated foam in situ, the foam characterized by a density of at least about 0.1 g/ml, a half life of greater than about twenty minutes, and a temperature of at least about 30° C., and wherein the foam contains a cleaning-effective amount of a drain cleaning active, and wherein a second quantity of said liquid remains in a liquid phase, the liquid phase characterized by a temperature of at least about 40° C., and wherein the liquid phase contains a cleaning-effective amount of an oxidant; and (b) allowing said drain cleaning active and said oxidant to remain in contact with the organic restriction material to react therewith.

24. The method of claim 23 wherein the liquid which generates foam in-situ is comprised of:

a first liquid, comprising an oxidant, and a surfactant, and having a viscosity of at least about 500 cP, a relaxation time of about 5–15 sec, and a relative elasticity of about 3–15 sec/Pa;

a second liquid, including a gas-generating agent; and a third liquid including a reducing agent and a surfactant, and having a viscosity of at least about 10 cP, a relaxation time of about 0.1–2 sec, and a relative elasticity of about 3–15 sec/Pa; and wherein the first, second and third liquids are disposed in a container such that they are separately maintained prior to forming an admixture during delivery to a drain to be treated.

25. The method of claim 23 wherein the drain pipe includes a sink, a vertical segment, a P-trap, and a sewer arm; and wherein the reaction between the first and second liquids occurs primarily in the sink, and the reaction between the first and third liquids occurs primarily in the P-trap.

26. The method of claim 23 wherein the oxidant is present in a stoichiometric excess over the gas-generating and reducing agents, wherein said excess acts as a drain-opening active.

27. The method of claim 23 wherein the heat generated is greater than about 50 Kcal/mole.

* * * * *